US007107885B2

(12) United States Patent
Chen

(10) Patent No.: US 7,107,885 B2
(45) Date of Patent: Sep. 19, 2006

(54) TOOL HANDLE SELF-CONTAINED A SET OF SCREWDRIVER BITS

(75) Inventor: Chun Yong Chen, Taipei (TW)

(73) Assignee: Nieh Chuang Industrial Co., Ltd., Taipei (TW)

( * ) Notice: Subject to any disclaimer, the term of this patent is extended or adjusted under 35 U.S.C. 154(b) by 96 days.

(21) Appl. No.: 10/867,672

(22) Filed: Jun. 16, 2004

(65) Prior Publication Data

US 2005/0247170 A1 Nov. 10, 2005

(30) Foreign Application Priority Data

May 7, 2004 (TW) ..... 93207139 U

(51) Int. Cl.
*B25G 1/08* (2006.01)
*B25B 23/16* (2006.01)

(52) U.S. Cl. ..... 81/490; 81/439; 81/177.4

(58) Field of Classification Search ..... 81/437–439, 81/490, 177.4
See application file for complete search history.

(56) References Cited

U.S. PATENT DOCUMENTS 5,566,596 A * 10/1996 Lin ..... 81/490
6,173,467 B1 * 1/2001 Chou ..... 81/490
6,196,093 B1 * 3/2001 Hu ..... 81/490
2002/0174749 A1 * 11/2002 Clemons ..... 81/490
2003/0024356 A1 * 2/2003 Kozak ..... 81/490

* cited by examiner

*Primary Examiner*—Debra S Meislin
(74) *Attorney, Agent, or Firm*—Troxell Law Office, PLLC

(57) ABSTRACT

A tool handle self-contained a set of screwdriver bits includes a handle and a set of screwdriver bits in the handle. There is a fixed hole provided on the bottom of the handle and a receiving groove provided on the side of the handle. The set of screwdriver bits includes a base, a pillar installed on the base and a plurality of holding parts installed on the base. On the upper end of the pillar, a step portion is provided and each holding part holds a screwdriver bit. After the set of screwdriver bits and the receiving groove are assembled, the bottom of the base and the handle become a smooth surface and the top face of the pillar in the hole of the receiving groove forms a pressing face. If the pressing face is pressed, the set of screwdriver bits will move out from the handle. After the screwdriver bit is locked at the bottom of the handle, it can act as screwdriver. A tool handle self-contained a set of screwdriver bits can suit for various hand tools.

5 Claims, 4 Drawing Sheets

TOOL HANDLE SELF-CONTAINED A SET OF SCREWDRIVER BITS

BACKGROUND OF THE INVENTION

1. Field of the Invention

The present invention relates to a tool handle self-contained a set of screwdriver bits, and particularly to a handle with screwdriver bit stored inside, of which appearance is continuous and smooth and slipping off does not easily occur. By pressing the pressing face of the set of screwdriver bits emerged at one side of the handle, the set of screwdriver bits can easily move out from the handle. The screwdriver bit can be locked at the bottom of the handle to become a screwdriver. The present invention suits for various hand tools.

2. Description of the Prior Art

In both the working place and at home, there are many opportunities to use various hand tools such as hammer, screwdriver . . . etc. for repairing objects in need of repair. This can let people enjoy the experience of completing a do-it-yourself (DIY) project while saving them the expense of paying a professional to perform the repairs.

There are many kinds of hand tools. In general, the hand tool people usually use with is the screwdriver. It is used to fasten or loose the screws on the objects such as watch, cell phone, buildings . . . etc. Each kind of screw needs its special screwdriver, for example, the cross-slotted screw needs Philip's type screwdriver and the hexagonal head screw needs hexagonal screwdriver to fasten or loose. It needs good tools that people want their work be well done. The more appropriate the screwdriver, the more efficient the job. Therefore, there are a lot of various screwdrivers for users to select and use.

The screwdriver has wide use. It is needed in various engineering jobs. In the prior technique, the screwdriver bit is directly connected with the handle to form a single tool and has an additional value of double functions, but its structure has only one specification and has limited use.

Therefore, the present invention wants to provide a tool handle, which can store various screwdriver bits in it and suits for various screwdriver, to improve the problems stated above.

SUMMARY OF THE INVENTION

The primary object of the present invention is to provide a tool handle self-contained a set of screwdriver bits. The set of screwdriver bits is hidden in the tool handle and can be easily moved out by pressing so that the device has pleasant appearance.

The other object of the present invention is to provide a tool handle self-contained a set of screwdriver bits, wherein the handle the user can select various screwdriver bits to form different screwdrivers for use various hand tools.

In order to achieve the objects stated above, the tool handle self-contained a set of screwdriver bits according to the present invention includes a handle for holding by the user and a set of screwdriver bits stored in the handle, whereon the bottom of the handle there is a fixed hole and in the fixed hole there is magnetic material for attracting the screwdriver bit inserted in to prevent the screwdriver bit from slipping off. At one side of the handle there is a receiving groove. At one side of the receiving groove there is a through hole and at another side there is an open hole.

The set of screwdriver bits has a base, a pillar provided on the base and a plurality of holding parts provided on the base, wherein at the upper end of the pillar there is a step portion and the holding part is a pair of detents with curved inner side. Each holding part can hold and lock a screwdriver bit. The bottom of the screwdriver bit can engage with the fixed hole at the bottom of the handle. After the set of screwdriver bits is inserted in the receiving groove, the bottom of the base of the set of screwdriver bits and the handle become a continuous and smooth surface, and the top face of the pillar forms a pressing face at the through hole of the receiving groove. By pressing the pressing face, the set of screwdriver bits can be easily moved out from the handle, and then the screwdriver bit can be locked at the bottom of the handle to become a screwdriver for use. The tool handle self-contained a set of screwdriver bits according to the present invention suits for various hand tools such as putty knives, scrapers or the similar tools. In order to deeply understand the present invention, there is a preferred embodiment with figures described in detail below.

DETAILED DESCRIPTION OF THE PREFERRED EMBODIMENT

Figure 1:
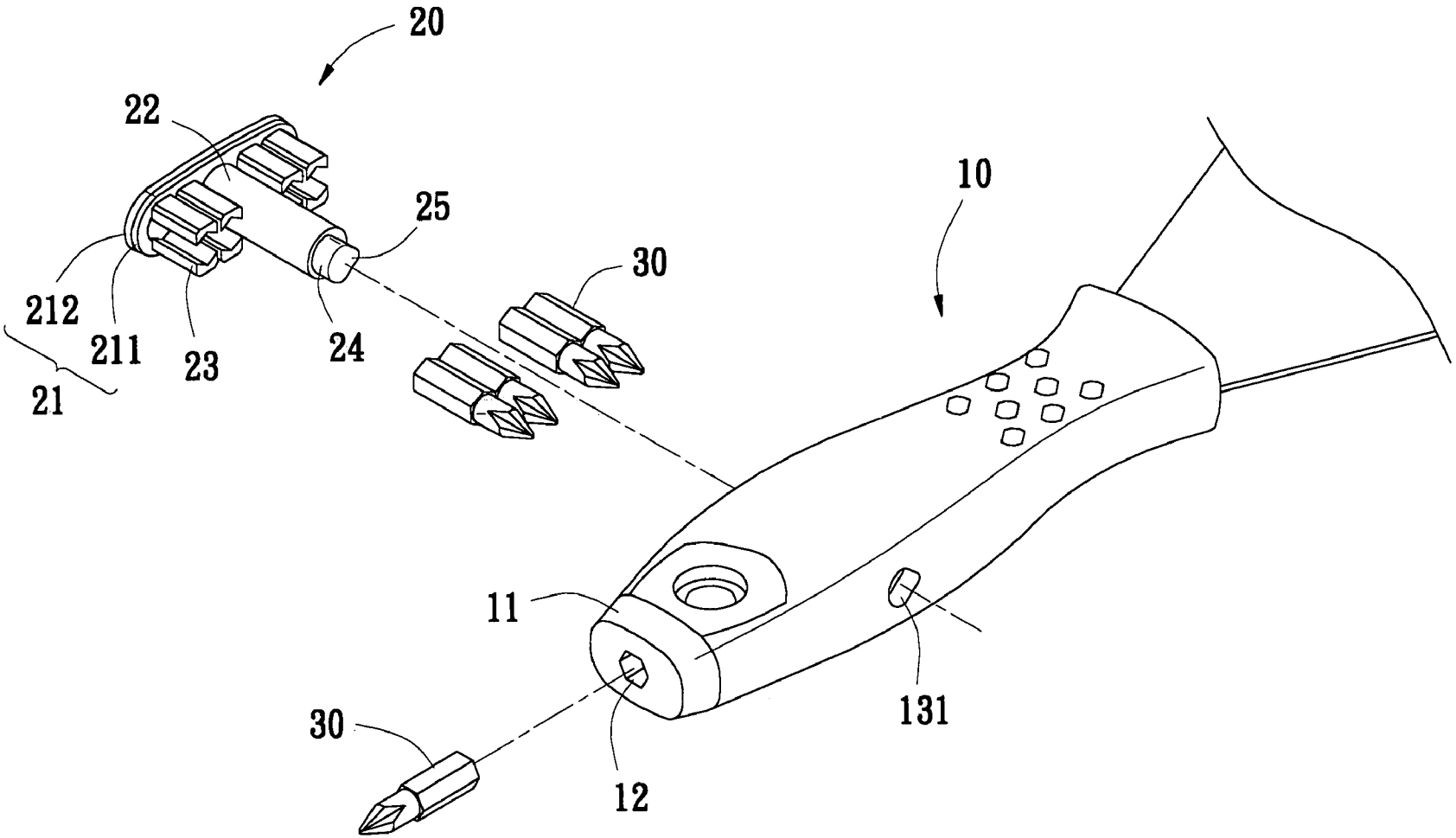
FIG. 1 is an exploded perspective view of a tool handle self-contained a set of screwdriver bits of the embodiment according to the present invention.
Figure 2:
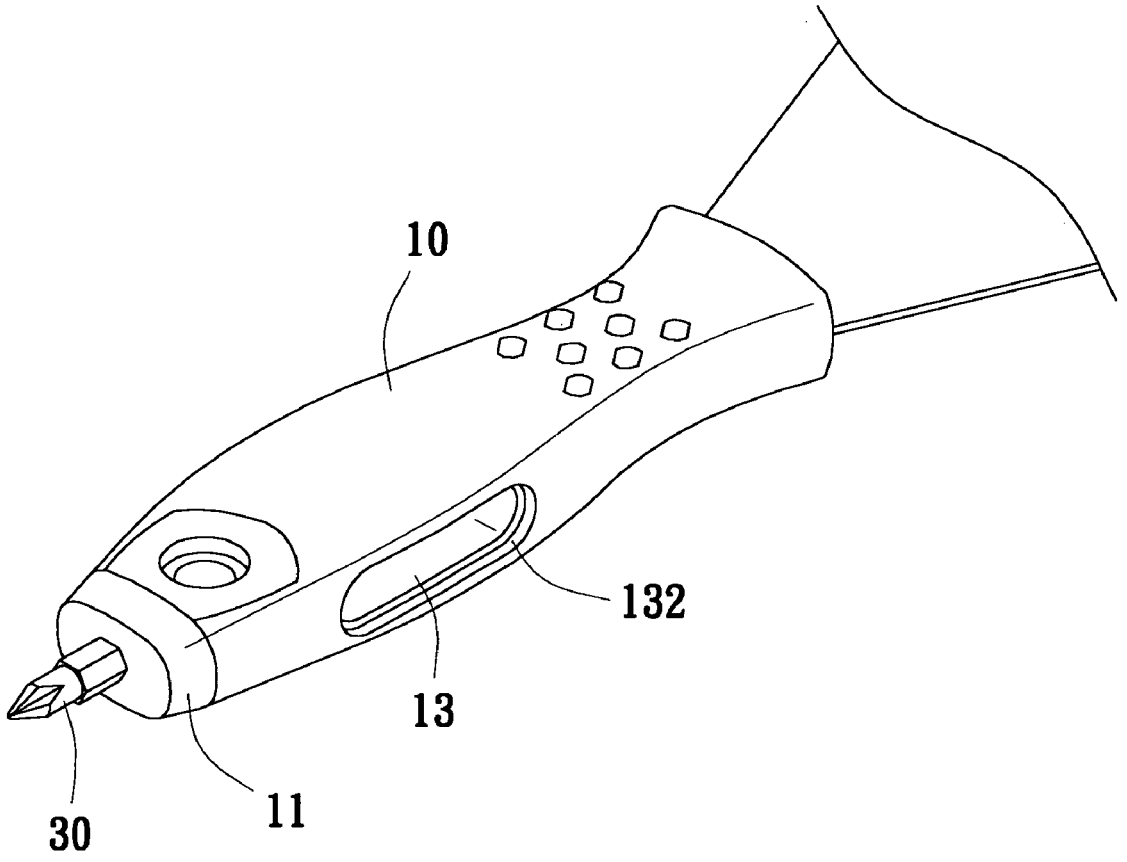
FIG. 2 is a perspective view of a tool handle self-contained a set of screwdriver bits of the embodiment according to the present invention.
Figure 3:
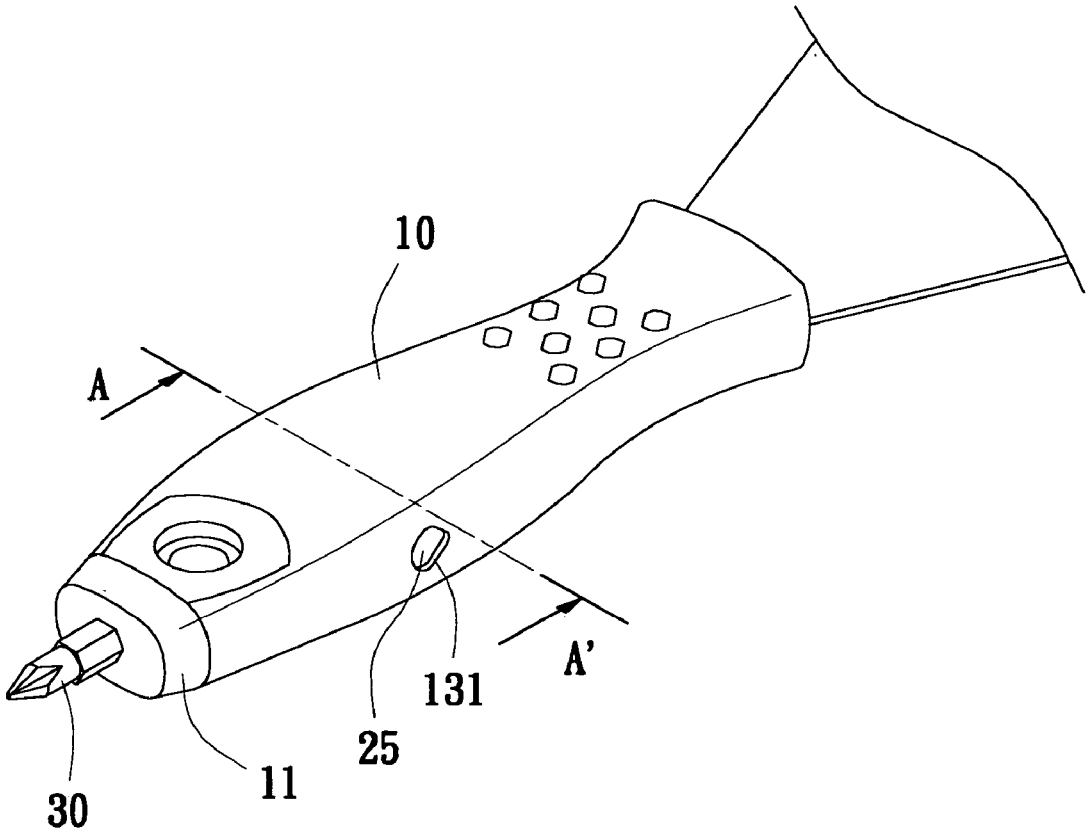
FIG. 3 is an assembly perspective view of a tool handle self-contained a set of screwdriver bits of the embodiment according to the present invention.
Figure 4:
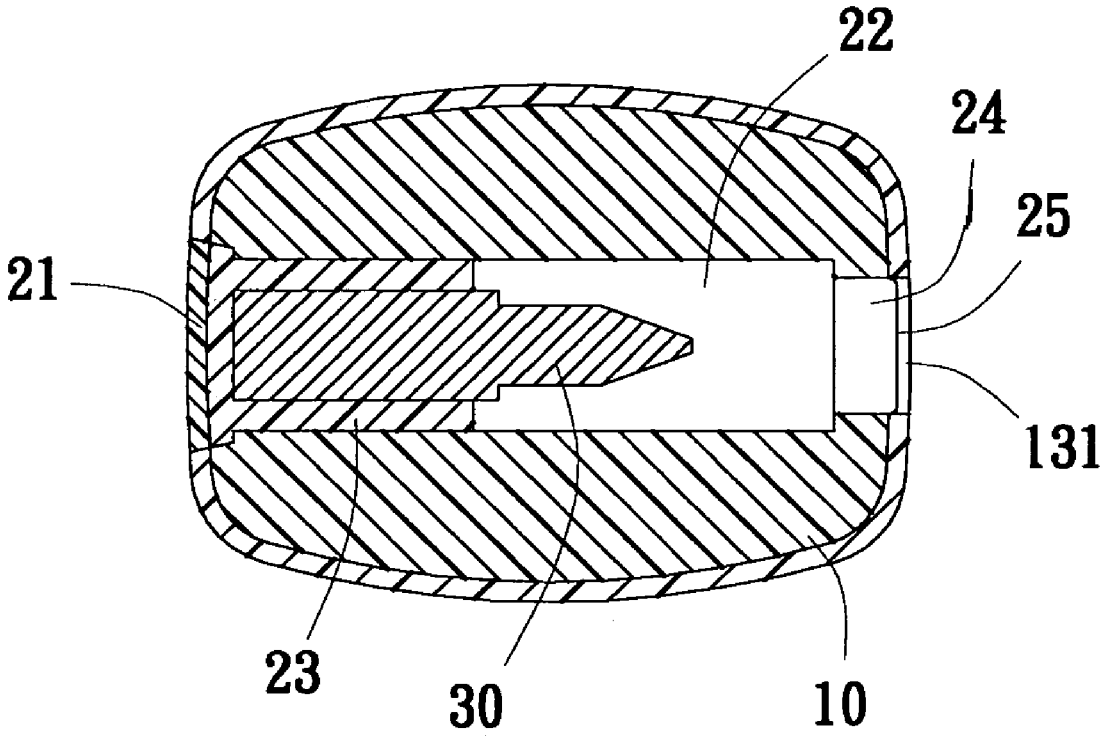
FIG. 4 is a sectional view taken along the A-line of FIG. 3.

Referring to FIGS. 1, 2, 3, and 4, the tool handle self-containing a set of screwdriver bits, in accordance with an embodiment of the present invention, includes a handle 10 for holding by the user and a set of screwdriver bits stored in the handle. The inside of the handle 10 is made of hard plastic and the surface of the handle 10 is covered with an elastic plastic skin so as to allow the user to securely grip the handle 10 without having the handle 10 slip in the user's hand. The bottom 11 of the handle 10 is covered with metal and provided with a fixed hole 12. In the hole 12 there is magnetic material for attracting ferrous substances. Preferably, one face of the handle 10 has a receiving groove 13 and an open hole 132, while an opposite face has a through hole 131. The open hole 132 is larger than the through hole 131 so that the set of screwdriver bits 20 can be inserted in the open hole 132 and emerge out the through hole 131 partly.

The set of screwdriver bits 20 includes a base 21, a pillar 22 provided on the base 21 and a plurality of holding parts 23 provided on the base 21. The base 21 of the set of screwdriver bits 20 has two layers 211, 212; the upper layer 211 is made of hard plastic and the lower layer 212 is made of the same elastic plastic as the surface of the handle 10 is covered. In the embodiment of the present invention, the holding part 23 on the base 21 is a pair of detents with curved inner side, which can lock the bottom of the screwdriver bit 30. There are four holding parts 23 in the embodiment of the present invention. Because one holding part 23 can lock one screwdriver bit 30 and there is an additional screwdriver bit 30 usually provided at the fixed hole 12, so there are at least five screwdriver bits 30 with different sizes and shapes such as PHILIP'S® head, flathead, hexagonal head . . . etc. in the tool handle of the embodiment.

In addition, at the upper end of the pillar 22 on the base 21 there is a step portion 24 and the top face 25 of the pillar 22 is oval in shape so that the step portion 24 of the pillar can match and insert in the through hole 131 of the receiving groove 13 in a specific position. If the direction of insertion is not right, the top face 25 of the pillar 22 then can not be inserted in the through hole 131 of the receiving groove 13.

After the set of screwdriver bits 20 and the receiving groove 13 are assembled, the bottom of the base 21 and the surface of the handle 10 can make the tool handle have a continuous and smooth surface, i.e. the bottom of the base 21 can just fill up the open hole 132 of the receiving groove 13. If the device is viewed from the open hole 132 side of the receiving groove 13, the set of screwdriver bits 20 can engage and hide in the handle 10 so that it does not easily slip off under the case of shaking or colliding. If the device is viewed from the groove hole 131 side of the receiving groove 13, the top face 25 of the pillar 22 becomes a pressing face at the through hole 131 of the receiving groove 13. If the pressing face 25 is pressed, the set of screwdriver bits 20 can easily move out from the receiving groove 13. Therefore, each screwdriver bit 30 cannot be easily lost and the handle 10 has pleasant appearance after assembling.

In application, the screwdriver bit 30 can be taken out from the holding part 23 and inserted in the fixed hole 12 on the bottom 11 of the handle. By rotating the handle 10, the various screw heads can be fastened or loosed. In addition, the magnetic material in the fixed hole 12 can firmly attract the screwdriver bit 30 so that the latter does not easily slip off. Therefore, in this preferred embodiment, the handle self-containing a set of screwdriver bits is both practical and convenient.

It must be noticed that the preferred embodiment stated above cannot be used to limit the scope of the present invention. The all changes and modifications to the embodiment by the persons who are skilled at this field must be regarded as the content of the present invention. The scope of the patent right applied by the present invention should be defined by the accompanying claims.

Therefore, the present invention has the following advantages:

1. After the set of screwdriver bits is received in the handle, the device has pleasant appearance and the set of screwdriver bits does not easily slip off. When the pressing face at one side of the handle is pressed, the set of screwdriver bits can be easily moved out from the handle. Its operation is simple and convenient.
2. The number and size of the screwdriver bits provided at the set of screwdriver bits can be changed and replaced according to the demand of the user. It is convenient for the user to change for various needs.
3. After the screwdriver bit is inserted and locked in the fixed hole of the handle, it can be attracted up by magnetic material so that it cannot easily slip off. The inconvenience due to loosening can be decreased.
4. The tool handle self-contained a set of screwdriver bits according to the present invention suits for various hand tools. It makes hand tool possess not only one function but also increase the additional value of hand tools, so it has very high utilization value in industry.

To sum up, the present invention indeed can accomplish its expected objects to provide a tool handle self-contained a set of screwdriver bits. The set of screwdriver bits is convenient to lock in or move out from the tool handle. The tool handle self-contained a set of screwdriver bits according to the present invention can suits for various hand tool.

Having thus described my invention, what I claim as new and desire to be secured by Letters Patent of the United States are:

1. A tool handle self-containing a set of screwdriver bits comprising:

a handle for holding by users; and a set of screwdriver bits contained in the handle, wherein the handle is provided with a fixed hole on the bottom and a receiving groove provided on one side of the handle, at one end of the receiving groove there is a through hole and at the other end of the receiving groove there is an open hole;

wherein the set of screwdriver bits includes:

a base;

a pillar provided on the base; and a plurality of holding parts provided on the base, wherein each holding part holds a screwdriver bit, and the bottom of each of the screwdriver bits is configured to selectively engage with the fixed hole at the bottom of the handle, wherein after the set of screwdriver bits and the receiving groove are assembled, a top face of the pillar in the through hole of the receiving groove forms a pressing face which can be pressed to move the set of screwdriver bits out, and make the bottom of the base and the handle have a continuous and smooth surface, wherein the upper end of the pillar has a step portion, of which the top face is oval in shape to allow the step portion of the pillar to be inserted in the through hole of the receiving groove.

2. The tool handle self-containing a set of screwdriver bits as claimed in claim 1, wherein the inside part of the handle is made of hard plastic and its surface is covered with an elastic plastic skin.

3. The tool handle self-containing a set of screwdriver bits as claimed in claim 1, wherein the base of the set of screwdriver bits has two layers, the upper layer is made of hard plastic and the lower layer is made of elastic plastic.

4. The tool handle self-containing a set of screwdriver bits as claimed in claim 1, wherein the fixed hole is magnetic material provided for attracting the screwdriver bit inserted in the hole.

5. The tool handle self-containing a set of screwdriver bits as claimed in claim 1, wherein the holding part is a pair of detents with curved inner face.

* * * * *